US009945383B2

(12) United States Patent
Wang

(10) Patent No.: US 9,945,383 B2
(45) Date of Patent: Apr. 17, 2018

(54) FAN DAMPING DEVICE FOR ADJUSTING MAGNETIC RESISTANCE

(71) Applicant: KEEN NEEK CO., LTD., Taichung (TW)

(72) Inventor: Chin-Liu Wang, Taichung (TW)

(73) Assignee: Keen Neek Co., Ltd., Taichung (TW)

( * ) Notice: Subject to any disclaimer, the term of this patent is extended or adjusted under 35 U.S.C. 154(b) by 429 days.

(21) Appl. No.: 14/856,207

(22) Filed: Sep. 16, 2015

(65) Prior Publication Data

US 2016/0298654 A1 Oct. 13, 2016

(30) Foreign Application Priority Data

Apr. 9, 2015 (TW) ..... 104205272 U

(51) Int. Cl.

| | |
|---|---|
| ***F04D 29/66*** | (2006.01) |
| ***F04D 29/32*** | (2006.01) |
| ***F04D 17/16*** | (2006.01) |
| ***A63B 21/005*** | (2006.01) |
| ***A63B 21/008*** | (2006.01) |

(52) U.S. Cl.
CPC ..... *F04D 17/16* (2013.01); *A63B 21/0051* (2013.01); *A63B 21/0088* (2013.01)

(58) Field of Classification Search
CPC ..... F04D 17/16; F04D 19/002; F04D 29/281; F04D 29/325; F04D 29/624; A63B 21/0051; A63B 21/0088
USPC ..... 188/267, 158, 159, 161, 164, 266.1, 188/266.6
See application file for complete search history.

(56) References Cited

U.S. PATENT DOCUMENTS

| | | | | |
|---|---|---|---|---|
| 5,020,792 | A * | 6/1991 | Chen | A63B 21/153 482/127 |
| 5,795,270 | A * | 8/1998 | Woods | A63B 21/0088 482/62 |
| 6,302,827 | B1 * | 10/2001 | Stevens | A63B 21/0051 188/164 |
| 9,586,087 | B1 * | 3/2017 | Lin | A63B 22/0664 |
| 2003/0045404 | A1 * | 3/2003 | Lin | A63B 21/0051 482/57 |
| 2005/0227822 | A1 * | 10/2005 | Liou | A63B 21/0056 482/57 |
| 2009/0084640 | A1 * | 4/2009 | Chen | H02K 49/043 188/164 |

* cited by examiner

*Primary Examiner* — Robert A. Siconolfi
*Assistant Examiner* — San M Aung
(74) *Attorney, Agent, or Firm* — Wang Law Firm, Inc.

(57) ABSTRACT

A fan damping device for adjusting magnetic resistance includes: a support frame, a fan wheel, a ring-shaped magnetic core, a magnetic control unit, and a control unit. The fan blades of the fan wheel can provide air resistance, and the magnetic control unit and the control unit provide adjustable magnetic resistance. By such arrangements, resistance can be increased without increasing the size and weight of the present invention. Besides, the resistance is adjustable as desired to improve convenience of use.

5 Claims, 4 Drawing Sheets

FAN DAMPING DEVICE FOR ADJUSTING MAGNETIC RESISTANCE

CROSS REFERENCE TO RELATED APPLICATION

This application claims the benefit of priority to TW 104205272, filed on Apr. 9, 2015 with the Intellectual Property Office of the Republic of China, Taiwan, the entire specification of which is incorporated herein by reference.

BACKGROUND OF THE INVENTION

Field of the Invention

The present invention relates to a fan damping device, and more particularly to a fan damping device for adjusting a magnetic resistance.

Related Prior Art

Pedaling exercise apparatuses mostly use a fly wheel and a magnetic attraction device to produce pedaling resistance. To broaden the range of the pedaling resistance, the size and weight of the magnetic attraction device must be increased. However, in addition to increase in cost, this will also substantially increase the weight of the exercise apparatus, which will cause inconvenience in transportation and become an obstacle to sales.

The present invention has arisen to mitigate and/or obviate the afore-described disadvantages.

SUMMARY

The present invention is aimed at providing a fan damping device for adjusting a magnetic resistance, which is capable of increasing resistance without increasing size and weight of magnetic attraction device.

To achieve the above objective, a fan damping device for adjusting magnetic resistance in accordance with a preferred embodiment of the present invention comprises:

a support frame;

a fan wheel rotatably mounted on the support frame, and including a disc portion and a plurality of neck portions with one end formed around an outer peripheral edge of the disc portion, and another end of each of the neck portions being twisted to form a fan blade which is arranged in a direction different from a direction of the disc portion, each of the neck portions defining an twisted angle with respect to the disc portion, wherein the twisted angle is larger than 0 degree and smaller or equal to 90 degrees;

a ring-shaped magnetic core fixed to the disc portion of the fan wheel and made of magnetically attracted material;

a magnetic control unit including a restricting member and a magnetic-control swing member, the restricting member being fixed to the support frame and including an arc-shaped restricting slot, the magnetic-control swing member including a magnetic base and a plurality of magnets, wherein the magnetic base has a pivoting end and an outer end, the magnetic base includes a first surface and an opposite second surface, a control portion is provided between the two ends of the magnetic base and protrudes away from the second surface, the magnetic base has the first surface located toward the restricting member and has the pivoting end pivoted to the restricting member, the pivoting end is located at a position different from the position of a center of the fan wheel, so that pivoting motion of the magnetic base can make the magnetic base move toward or away from the ring-shaped magnetic core, the control portion of the magnetic base extends out of the restricting slot and is movable between two ends of the restricting slot, the magnets are dispersed on the second surface of the outer end of the magnetic base; and a control unit being connected to the control portion and capable of pulling the control portion to move or release the control portion.

The fan blades of the fan wheel can provide air resistance, and the magnetic control unit and the control unit provide adjustable magnetic resistance. By such arrangements, resistance can be increased without increasing the size and weight of the present invention. Besides, the resistance is adjustable as desired to improve convenience of use.

DETAILED DESCRIPTION

Figure 1:
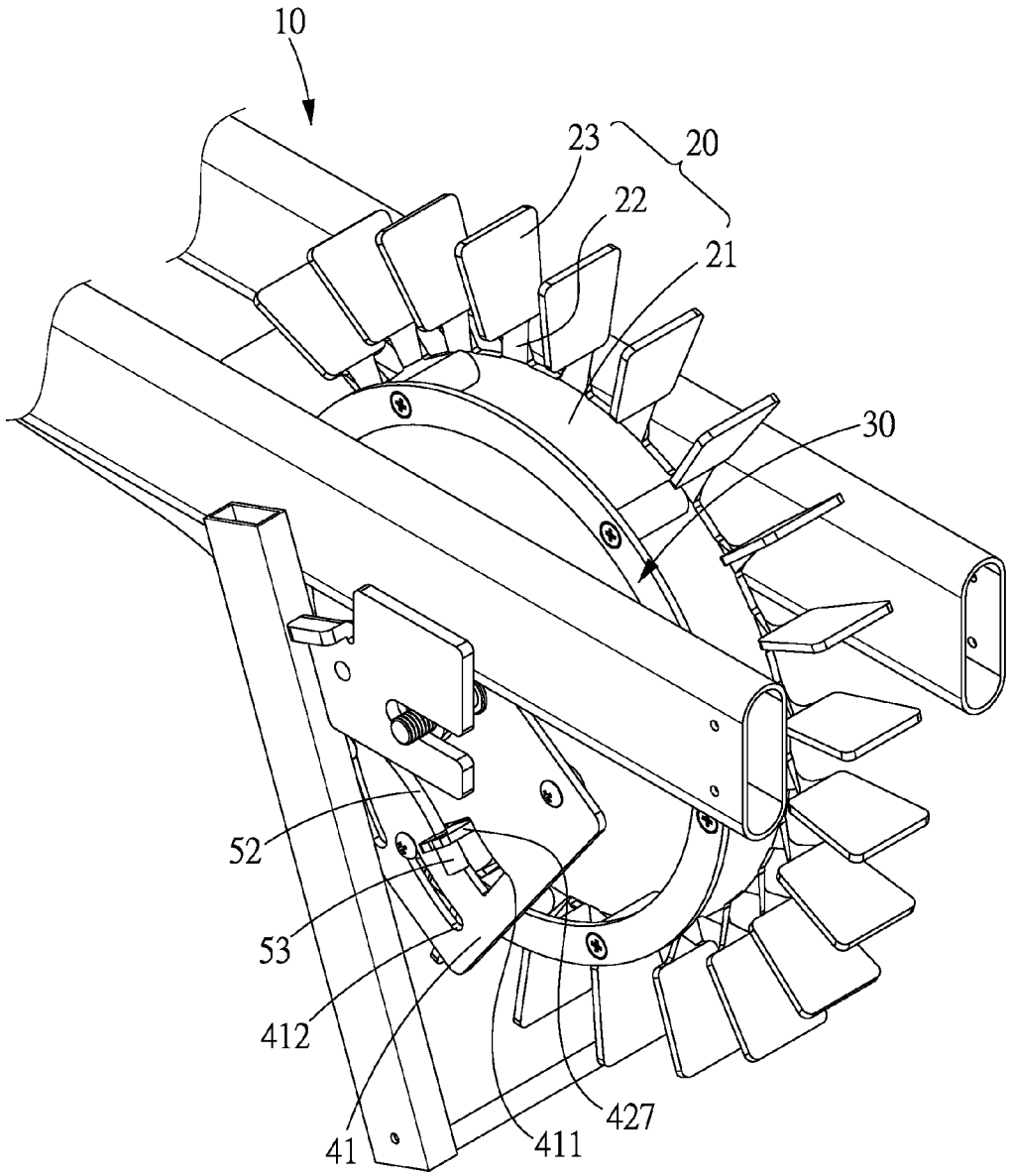
FIG. 1 is a perspective view of a fan damping device in accordance with a preferred embodiment of the present invention.
Figure 2:
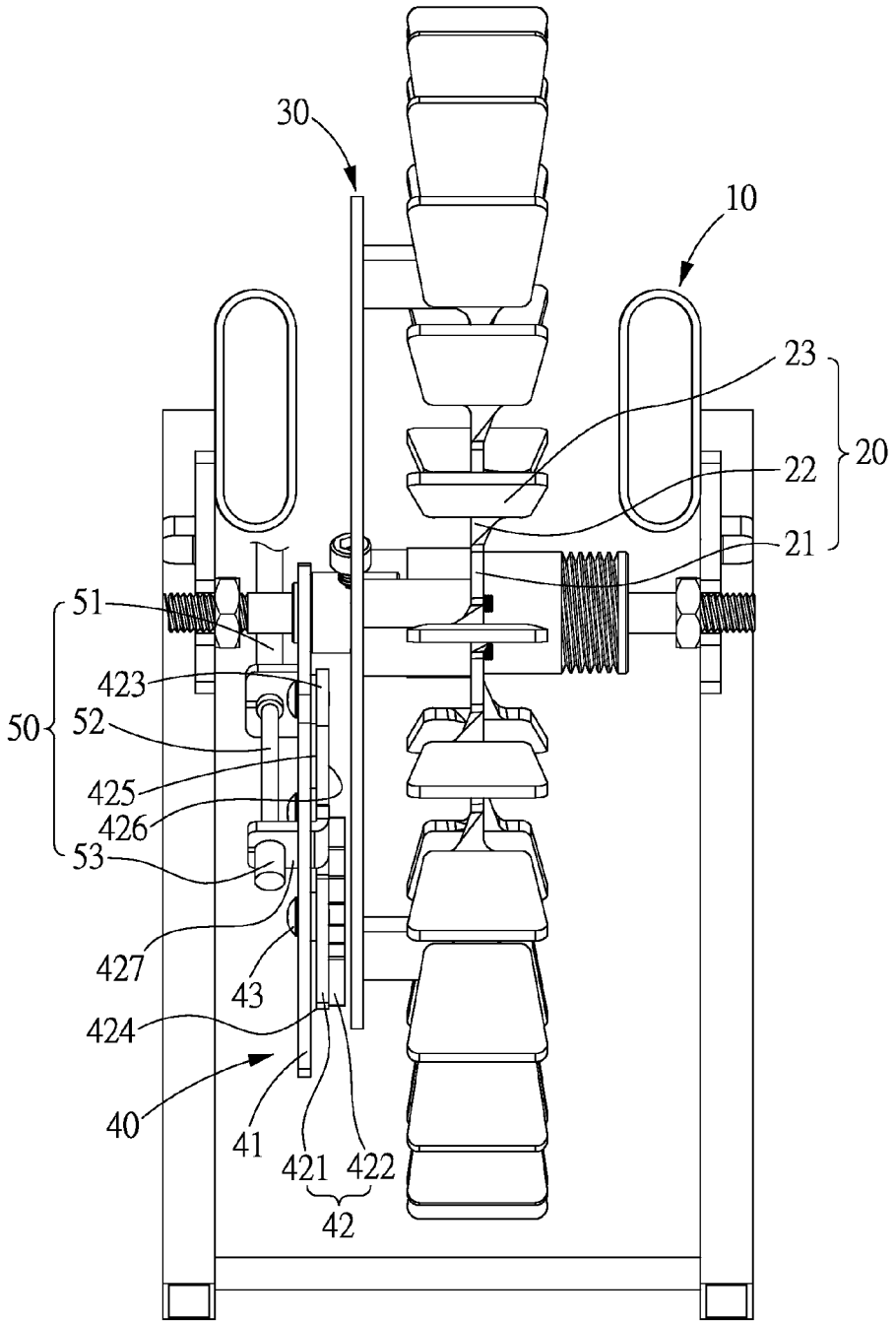
FIG. 2 is a side view of the fan damping device in accordance with a preferred embodiment of the present invention.

The present invention will be clearer from the following description when viewed together with the accompanying drawings, which show, for purpose of illustrations only, the preferred embodiment in accordance with the present invention.

Referring to FIGS. 1-4, a fan damping device for adjusting a magnetic resistance in accordance with a preferred embodiment of the present invention comprises: a support frame 10, a fan wheel 20, a ring-shaped magnetic core 30, a magnetic control unit 40, and a control unit 50.

The fan wheel 20 is rotatably mounted on the support frame 10, and includes a disc portion 21 and a plurality of neck portions 22 with one end formed around the outer peripheral edge of the disc portion 21, and another end of each of the neck portions 22 is twisted to form a fan blade 23. The twisting of the neck portions 22 make the direction of the fan blades 23 different from the direction of the disc portion 21, each of the neck portions 22 defines an twisted angle with respect to the disc portion 21, and the twisted angle is larger than 0 degree and smaller or equal to 90 degrees. The fan wheel 20 has the center of the disc portion 21 pivoted to the support frame 10.

The ring-shaped magnetic core 30 is fixed to the peripheral edge of the disc portion 21 of the fan wheel 20 and made of magnetically attracted material.

The magnetic control unit 40 includes a restricting member 41 and a magnetic-control swing member 42. The restricting member 41 is fixed to the support frame 10 and includes an arc-shaped restricting slot 411 and a plurality of arc-shaped guiding slots 412. The magnetic-control swing member 42 includes a magnetic base 421 and a plurality of magnets 422. The magnetic base 421 has a pivoting end 423 and an arc-shaped outer end 424. The magnetic base 421 includes a first surface 425 and an opposite second surface 426. Between the two ends of the magnetic base 421 is provided a control portion 427 which protrudes away from the second surface 426. The magnetic base 421 has the first surface 425 located toward the restricting member 41 and has the pivoting end 423 pivoted to the restricting member 41. The pivoting end 423 is located at a position different from the position of the center of the fan wheel 20, namely the pivoting end 423 is located eccentrically with respect to the center of the fan wheel 20, so that pivoting motion of the magnetic base 421 can make the magnetic base 421 move toward or away from the ring-shaped magnetic core 30, namely, changing the position of the magnetic base 421 with respect to the ring-shaped magnetic core 30. The control portion 427 of the magnetic base 421 extends out of the restricting slot 411 to restrict the displacement of the magnetic base 421, and is movable between two ends of the restricting slot 411. The magnets 422 are dispersed on the second surface of the outer end 424 of the magnetic base 421. In each of the guiding slots 412 is disposed a guiding member 43 with one end connected to the magnetic-control swing member 42, and the guiding member 43 is also movable between two ends of the guiding slots 412.

The control unit 50 is connected to the control portion 427 and capable of pulling the control portion 427 to move or release the control portion 427. In this embodiment, the control unit 50 includes an outer pipe 51 and an inner pipe 52 movably sleeved onto the outer pipe 51 in such a manner that the inner pipe 52 has two ends extended out of the outer pipe 51. The outer pipe 51 is fixed on the restricting member 41, one end of the inner pipe 52 is to be controlled and pulled, and another end of the inner pipe 52 is inserted through the control portion 427 and fixed by a restricting head 53. The restricting head 53 restricts the inner pipe 52 to move in a unidirectional manner. The restricting slot 411 has one end located adjacent to the outer pipe 51 and another end located farther away from the outer pipe 51.

Figure 3:
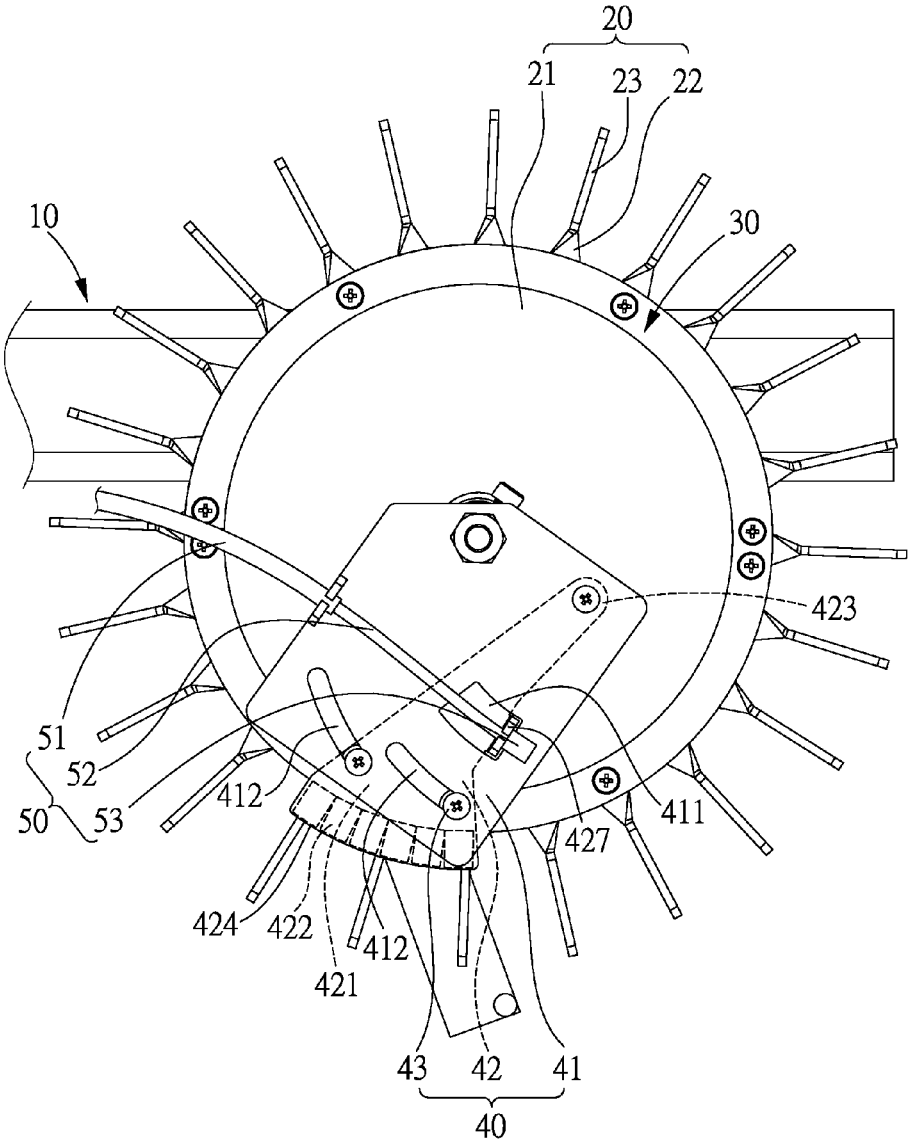
FIG. 3 is a plan view showing the minimum resistance status of the fan damping device in accordance with a preferred embodiment of the present invention.

What mentioned are the structural relations and the features of the fan damping device for adjusting the magnetic resistance in accordance with a preferred embodiment of the present invention. The present invention can be used on an exercise equipment as a damping device (resistance generator). When the fan wheel 20 rotates, the fan blades 23 will produce air resistance to provide damping resistance. Namely, the air resistance produced by the fan wheel 20 is the minimum resistance provided by the fan damping device of the present invention, and the fan damping device of the present invention in this status has not produced any magnetic resistance yet, as shown in FIG. 3.

Still in this status, the inner pipe 52 of the control unit 50 extends out of the outer pipe 51, and the restricting head 53 and the control portion 427 of the magnetic-control swing member 42 are in a released state. Since the control portion 427 is in a release state, the magnetic-control swing member 42 is also in a released state will pivot downward by weight until the control portion 427 is abutted against the another end of the restricting slot 411 which is located farther away from the outer pipe 51. Namely, the resistance of the fan wheel 20 mainly comes from the air resistance of the fan blades 23.

Figure 4:
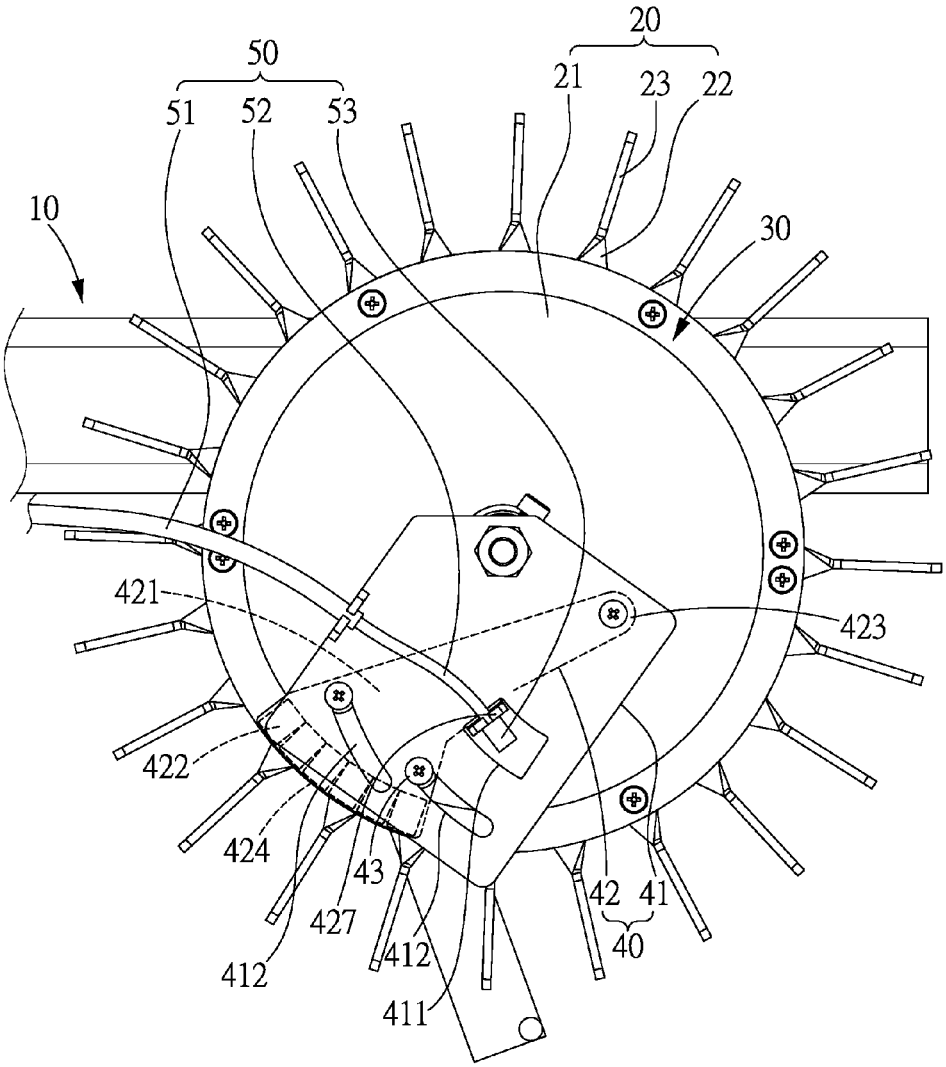
FIG. 4 is a plan view showing the maximum resistance status of the fan damping device in accordance with a preferred embodiment of the present invention.

To increase the resistance of the fan wheel 20, a user can pull the inner pipe 52 of the control unit 50 to move the restricting head 53 toward the outer pipe 51, meanwhile, the restricting head 53 also pushes the control portion 427 of the magnetic-control swing member 42 to move. Therefore, the magnetic-control swing member is caused to rotate to make the outer end 424 move gradually toward the ring-shaped magnetic core 30, so that the magnetic resistance is produced to increase the resistance of the fan wheel 20. Keep pulling the inner pipe 52, the restricting head 53 of the inner pipe 52 will finally be moved to the one end of the restricting slot 411 which is located adjacent to the outer pipe 51, as shown in FIG. 4. At this moment, the outer end 424 of the magnetic-control swing member 42 fully moves to the position aligned with the position of the ring-shaped magnetic core 30 to provide a maximum magnetic resistance. At this moment, the resistance of the fan wheel 20 reaches the maximum value, namely, the sum of the air resistance generated by the fan blades 23 and the magnetic resistance.

It can be learned from the above description that the fan blades 23 of the fan wheel 20 can provide air resistance, and the magnetic control unit 40 and the control unit 50 provide adjustable magnetic resistance. By such arrangements, resistance can be increased without increasing the size and weight of the present invention. Besides, the resistance is adjustable as desired to improve convenience of use.

While we have shown and described various embodiments in accordance with the present invention, it is clear to those skilled in the art that further embodiments may be made without departing from the scope of the present invention.

What is claimed is:

1. A fan damping device for adjusting a magnetic resistance, comprising:

a support frame;

a fan wheel rotatably mounted on the support frame, and including a disc portion and a plurality of neck portions with one end formed around an outer peripheral edge of the disc portion, and another end of each of the neck portions being twisted to form a fan blade which is arranged in a direction different from a direction of the disc portion, each of the neck portions defining an twisted angle with respect to the disc portion, wherein the twisted angle is larger than 0 degree and smaller than or equal to 90 degrees;

a ring-shaped magnetic core fixed to the disc portion of the fan wheel and made of magnetically attracted material;

a magnetic control unit including a restricting member and a magnetic-control swing member, the restricting member being fixed to the support frame and including an arc-shaped restricting slot, the magnetic-control swing member including a magnetic base and a plurality of magnets, wherein the magnetic base has a pivoting end and an outer end, the magnetic base includes a first surface and a second surface opposite to the first surface, a control portion is provided between the pivoting end and the outer end of the magnetic base and protrudes away from the second surface, the magnetic base has the first surface located toward the restricting member and has the pivoting end pivoted to the restricting member, the pivoting end is located at a position different from a position of a center of the fan wheel, so that a pivoting motion of the magnetic base can make the magnetic base move toward or away from the ring-shaped magnetic core, the control portion of the magnetic base extends out of the restricting slot and is movable between two ends of the restricting slot, the magnets are dispersed on the second surface of the outer end of the magnetic base; and a control unit being connected to the control portion and capable of pulling the control portion to move or release the control portion.

2. The damping device as claimed in claim 1, wherein the magnetic core is a ring-shaped member fixed to a peripheral edge of the fan wheel.

3. The damping device as claimed in claim 1, wherein the outer end of the magnetic base is arc-shaped.

4. The damping device as claimed in claim 1, wherein the restricting member includes a plurality of arc-shaped guiding slots and a plurality of guiding members disposed in each of the guiding slots respectively, and each of the guiding members has one end connected to the magnetic-control swing member.

5. The damping device as claimed in claim 1, wherein the control unit includes an outer pipe and an inner pipe movably sleeved onto the outer pipe in such a manner that the inner pipe has two ends extended out of the outer pipe, the outer pipe is fixed on the restricting member, one end of the inner pipe is to be controlled and pulled, and another end of the inner pipe is inserted through the control portion and fixed by a restricting head, the restricting head restricts the inner pipe to move in a unidirectional manner, and the restricting slot has one end located adjacent to the outer pipe and another end located farther away from the outer pipe.

* * * * *